United States Patent [19]

Crick et al.

[11] Patent Number: 4,874,041

[45] Date of Patent: Oct. 17, 1989

[54] BAR SUPPORT SHIM AND METHOD

[75] Inventors: David L. Crick; James K. Hayes, both of Chattanooga, Tenn.

[73] Assignee: Combustion Engineering, Inc., Windsor, Conn.

[21] Appl. No.: 109,874

[22] Filed: Oct. 19, 1987

[51] Int. Cl.[4] ..... F28D 7/00

[52] U.S. Cl. ..... 165/162; 165/69; 165/82; 165/76

[58] Field of Search ..... 165/162, 82, 76, 69

[56] References Cited

U.S. PATENT DOCUMENTS

| | | | |
|---|---|---|---|
| 2,905,742 | 9/1959 | Woods | 165/69 X |
| 3,292,691 | 12/1966 | Welter et al. | 165/69 X |
| 4,216,824 | 8/1980 | Braun et al. | 165/69 |
| 4,735,260 | 9/1988 | Wöhrl et al. | 165/69 |

*Primary Examiner*—Larry Jones

*Attorney, Agent, or Firm*—John H. Mulholland

[57] ABSTRACT

A nuclear steam generator having anti-vibration bars for limiting the motion of spaced heat exchanging tubes is provided with a shim located between every $n^{th}$ tube where n is greater than 1. The shims have a thickness equal to n times the dimensional difference (x−y) of the distance x between a pair of tubes and the width y of an anti-vibration bar between the tubes. The shim is of channel-shape and is put in position by cutting and removing the wrap-around bars from the outside of the tube bundle, inserting and expanding a bladder to spread the pair of tubes in the bundle on opposite sides of an anti-vibration bar, moving the anti-vibration bar between the pair of tubes to one side of the opening created by the bladder, inserting a shim of modular links between the anti-vibration bar and one tube of the pair of tubes and repeating the bladder inserting, expanding and anti-vibration bar moving steps to insert shims at intervals n along the bundle. Thereafter, a new wrap-around bar is welded to the ends of the anti-vibration bars on the outside of the tube bundle.

5 Claims, 6 Drawing Sheets

STEP 1 CUT AND REMOVE WRAP-AROUND BAR - REMOTE E.D.M. UNDER WATER TORCH OR SAW.

STEP 2 INSERT AND EXPAND BLADDER TO SPREAD TUBES APART - START IN MIDDLE OF BUNDLE.

STEP 3 AFTER TUBES HAVE BEEN SPREAD, MOVE ANTI-VIBRATION BAR TO ONE SIDE OF OPENING.

STEP 4 INSERT FIRST SEGMENT OF ANTI-VIBRATION BAR SHIM APPROXIMATELY 12" LONG EACH.

STEP 5 CONTINUE UNTIL FIRST ANTI-VIBRATION BAR IS COMPLETE.

STEP 6 WELD LAST SHIM TO TOP OF ANTI-VIBRATION BAR TO SECURE.

STEP 7 CONTINUE ADDING SHIMS TO EVERY 10TH ANTI-VIBRATION BAR UNTIL BUNDLE IS COMPLETED.

STEP 8 WELD NEW WRAP-AROUND BAR TO ANTI-VIBRATION BARS.

Fig. 10

BAR SUPPORT SHIM AND METHOD

BACKGROUND OF THE INVENTION

1. Field of the Invention

The invention relates to nuclear steam generators for nuclear power plants and more particularly to a shimming system including a structure and a method for fixing existing steam generators with the potential for excessive heat exchange tube damage from vibration.

2. Prior Art

An earlier method of expanding flattened tubes to reduce vibration amplitudes in nuclear steam generators is the subject of U.S. Pat. No. 4,624,304, assigned to the same assignee as the instant invention.

U.S. Pat. Nos. 4,640,342 and 4,653,576 relate to expensive expandable anti-vibration bar arrangements for use in nuclear steam generators having anti-vibration bars located between the U-shaped tubes and attached at their ends to wrap-around bars or retainer rings on the outside of the tube bundle in the area of the tube bends.

The wear problem that exists due to the anti-vibration bar type of heat exchanger is in the upper heat exchange tube bundle between the tubes and the anti-vibration bars or tube supports which separate columns of pairs of tubes. These upper tube supports have an original clearance with pairs of tubes between which they pass. Thus, there is a given distance x, typically 0.359 inches, between the pairs of tubes and a width y, typically 0.340 inches, of the anti-vibration bar which leaves room, typically 0.19 inches, for tube vibration amplitude.

The purpose of the anti-vibration bars is to limit the movement of the tubes when subjected to flow induced vibration that tends to occur when two phase flow exists on the exterior of the tubes. The anti-vibration bars were designed to limit the amount of motion of the tubes. It is apparent that the designers of this type of steam generator were striving to limit the cyclic bending stresses on the tubes and minimize the possibility of tubes impacting against each other. Unfortunately, in the commercial embodiment in use, the utilization of anti-vibration bars with a typical nominal clearance of 0.0095 inches between each anti-vibration bar and adjacent tube has resulted in excessive wear of the tubes during service. In some instances, this design has required that the tubes be plugged to prevent a primary coolant passage to the secondary side of the heat exchanger, through tube walls, during operation of the steam generator.

SUMMARY OF THE INVENTION

The invention is a system which results in an improved nuclear steam generator structure by use of a method of modifying a nuclear steam generator of the type having anti-vibration bars for limiting the motion of U-shaped heat exchanging tubes.

The method results in an improved structure which has a shim located between every $n^{th}$ tube. The shims have a thickness equal to n times the dimensional difference $(x-y)$ of the distance x between a pair of tubes and the width y of an anti-vibration bar between the tubes, where n is greater than one. The shims are channel-shaped in cross-section and the channel is dimensioned to receive an anti-vibration bar. The completed shims are made up lengthwise of a plurality of modules, and are attached at their ends to a wrap-around bar on the outside of the tube bundle.

The novel method of reducing vibration damage to heat exchanging tubes of the tube bundle in a nuclear steam generator having anti-vibration bars located between the tubes and attached at their ends to wrap-around bars on the outside of the tube bundle includes the steps as described below.

First, the wrap-around bar is cut by means of a remote electron discharge machine (E.D.M.) operation or an underwater torch or saw. It should be clear in this regard that the steam generator need not be drained for performance of the method.

A bladder is then inserted and expanded to spread pairs of tubes in the middle of the bundle on opposite sides of an anti-vibration bar. After the tubes have been spread, the anti-vibration bar between the pairs of tubes is moved to one side of the expanded opening and a channel-shaped shim module approximately 12 inches long is inserted. Additional modules are inserted until the first shim shrouded anti-vibration bar is complete. The last shim module is then welded to the top of the anti-vibration bar.

The bladder inserting and expanding, the anti-vibration bar moving and the shim module inserting and welding steps are then repeated at intervals n, typically, $n=10$, along the bundle. Subsequently, a wrap-around bar is welded to the ends of the anti-vibration bars on the outside of the tube bundle to complete the improved steam generator structure.

The improved design substantially eliminates the clearance between the tubes and the anti-vibration bars thus ensuring substantially continuous contact between the tubes and these supports. This substantially eliminates any damage-causing impacting between the tubes and the supports and, ideally, restrains the tubes to some extent to mimimize wear due to sliding action.

BRIEF DESCRIPTION OF THE DRAWINGS

FIG. 10 is a chart of the steps of the method of improving the nuclear steam generator structure of FIG. 1 according to the principles of the invention.

DESCRIPTION OF THE PREFERRED EMBODIMENT

Figure 1:
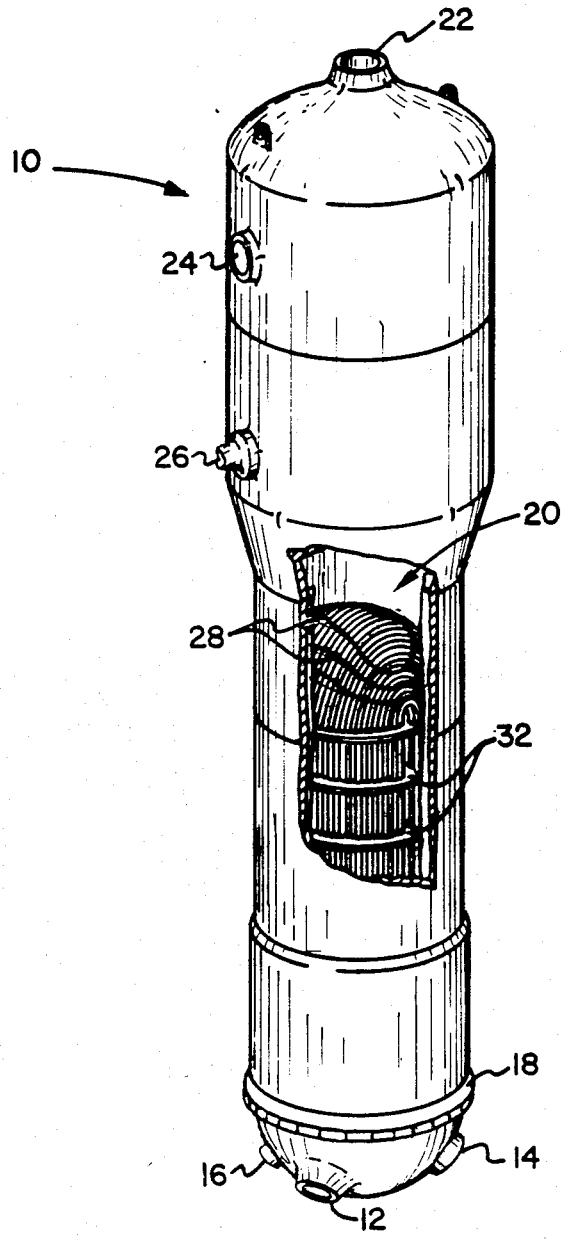
FIG. 1 is a schematic perspective view of a nuclear steam generator having a bundle of U-shaped heat exchanging tubes of the type which includes anti-vibration bars and wrap-around bars.
Figure 2:
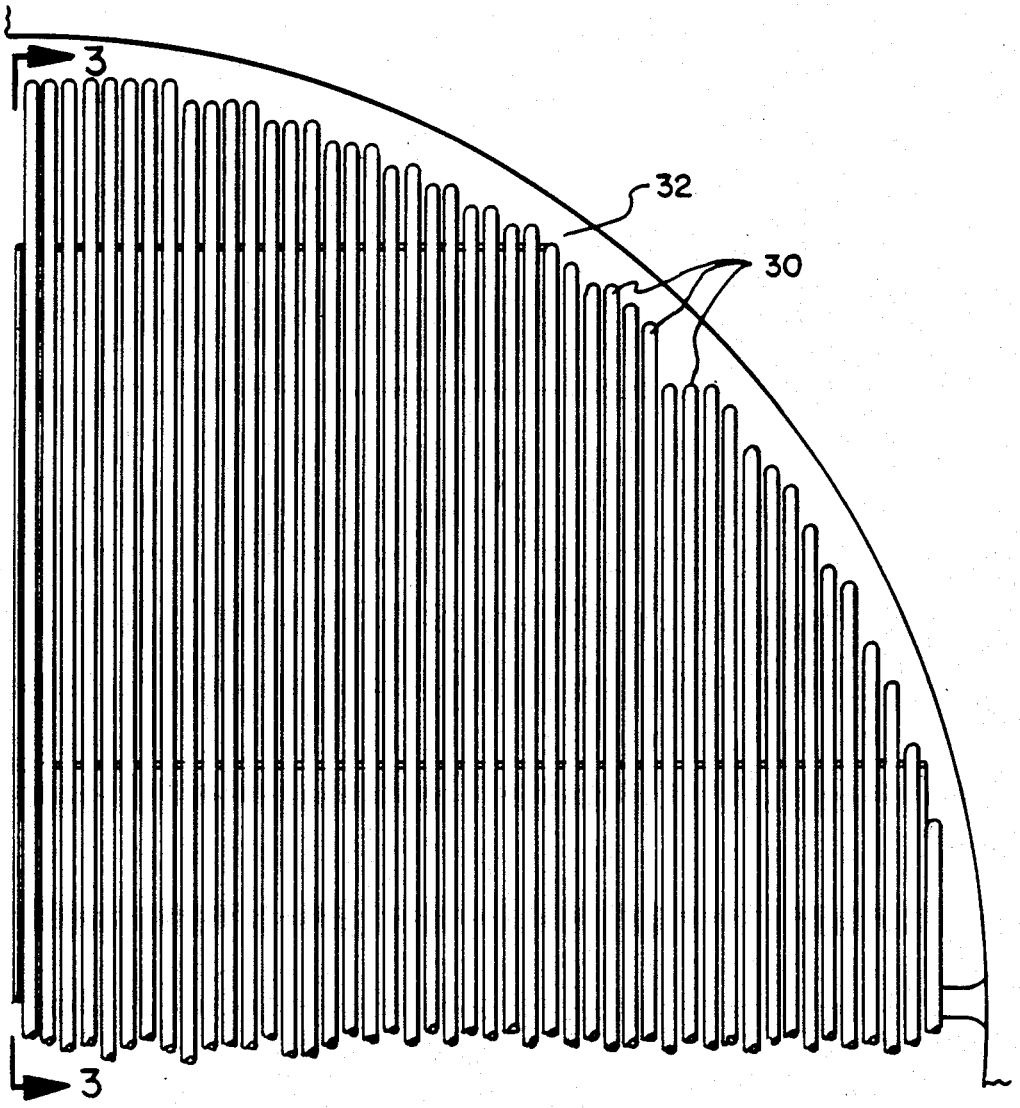
FIG. 2 is a fragmentary plan view of the tube bundle of the steam generator of FIG. 1.

The numeral 10 generally designates a steam generator of a nuclear steam supply system of the type with which the present invention is involved. The steam generator 10 has primary coolant nozzles 12 and 14 through which the coolant on the primary side, in fluid communication with a nuclear reactor, respectively enters and exits the steam generator 10. A manway 16 is provided in the lower end for access to the primary chamber which is surrounded by a structure called a primary head. The primary side is separated from the secondary side by a tube plate or tube sheet and support ring shown at 18 in which the U-shaped tubes of a tube bundle, generally designated 20 begin and terminate in known matter. The upper end of the steam generator has a steam outlet 22, a manway 24 for repair access, and a feed water inlet nozzle 26. Other internals of the steam generator are not material to the instant invention.

Figure 3:
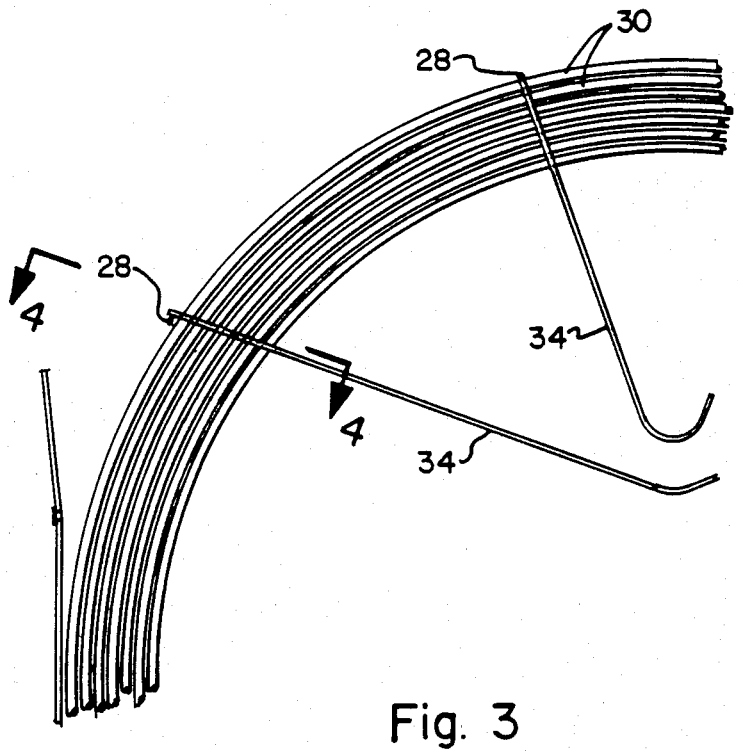
FIG. 3 is a reduced fragmentary cross-sectional view of the tube bundle of FIG. 2 taken along line 3—3 of FIG. 2.

Wrap-around bars 28, shown on the exterior of the tube bundle 20 and as seen in FIG. 3, are adjacent the outermost of the tubes 30 of the tube bundle 20. The tube bundle 20 is made up of the tubes 30 and tube supports 32 which are spaced at intervals along the straight portions of the tubes 30.

Figure 4:
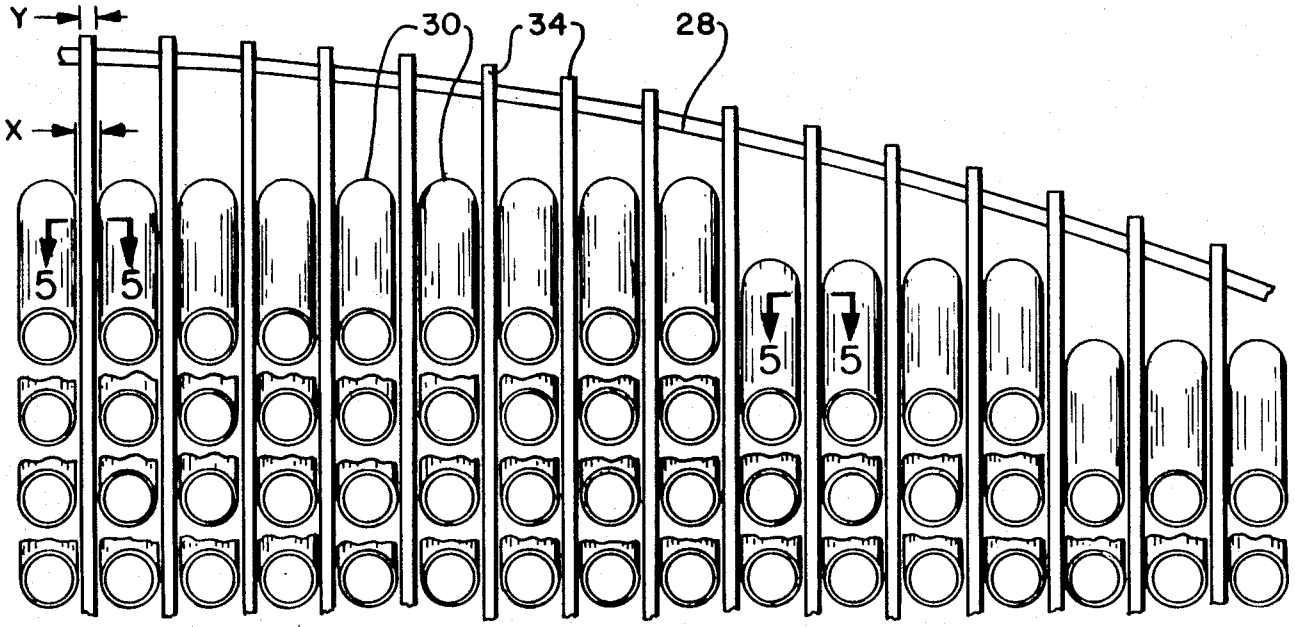
FIG. 4 is an enlarged fragmentary cross-sectional view taken along the line 4—4 of FIG. 3.
Figure 6:
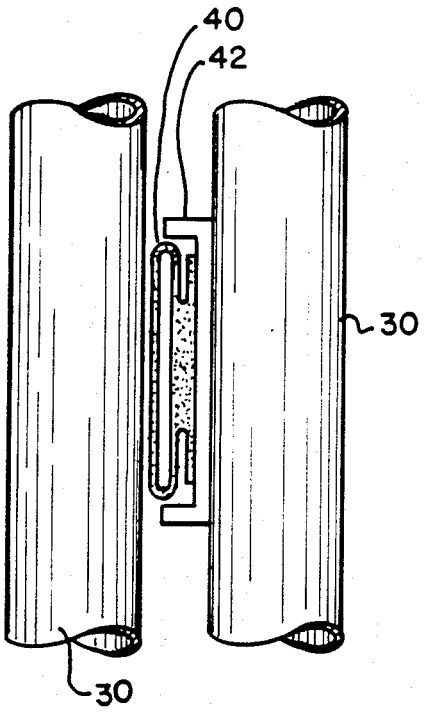
FIG. 6 is a view similar to FIG. 5 with the bladder tool in place.
Figure 7:
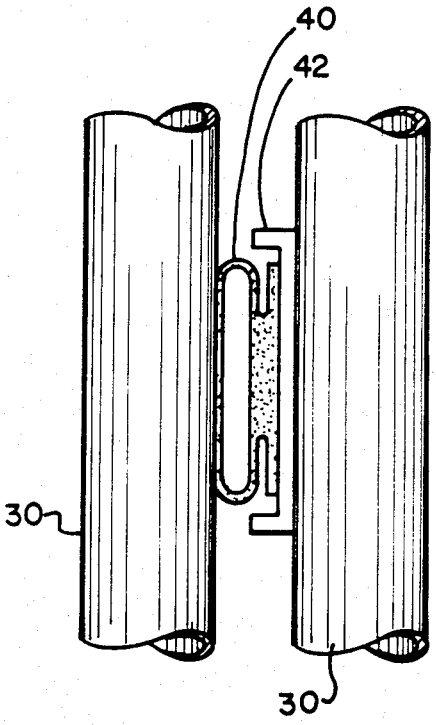
FIG. 7 is a view similar to FIG. 6 with the bladder expanded.
Figure 8:
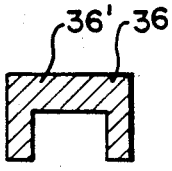
FIG. 8 is a cross-sectional view of a shim module.

Attached to the wrap-around bars 28 and lying between the columns of tubes 30 are anti-vibration bars 34. The cross-sectional view of FIG. 4 shows the columns of pairs of tubes 30 with anti-vibration bars 34 therebetween. The dimension x, in FIG. 4, is the distance between a pair of tubes and the dimension y is the width of an anti-vibration bar which is between the pair of the tubes.

Figure 5:
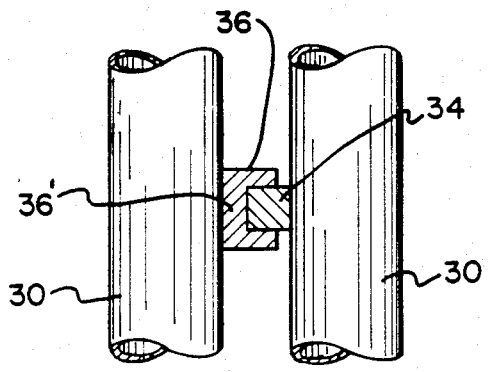
FIG. 5 is an enlarged fragmentary cross-sectional view taken along the lines 5—5 of FIG. 4.

FIG. 5 shows the resulting improved structure of the method which is created by the novel procedure of the method. A shim 36 of U-shaped channel cross-section is dimensioned to receive the anti-vibration bar 34 and is positioned with the anti-vibration bar to substantially fill the dimension x. Shim 36 is placed in a position shrouding the anti-vibration bar 34 on three of its sides between the pair of tubes 30.

The method of placing the shim 36 in the position seen in FIG. 5 includes the first step of cutting and removing the wrap-around bar 28 by remote electron discharge machine (E.D.M.) or by underwater torch or saw. After this is accomplished, the elongated bladder 40, mounted in a U-shaped support 42, is inserted adjacent the anti-vibration bar 34 between a pair of tubes 30 to spread the tubes apart. Preferably, this procedure is begun in the middle of the bundle 20 and, because of the expense of time and involvement in operating under water, need not be done on every anti-vibration bar but merely at intervals n along the bundle such as at every tenth anti-vibration bar. Thus, the size of the shim in the dimension of its base portion 36' lying between the anti-vibration bar 34 and the tube 30, will be such that n times the dimemsional difference (x−y) of the distance x between a pair of tubes 30 and the width y of an anti-vibration bar 34 between the tubes 30 will take up all of the accumulative, typically (0.0095 inches), gap between a tube 30 and the anti-vibration bar 34. Since the total of these gaps is approximately 0.19 inches in the typical example given, the shim distance 36' will be in this example 0.19 inches or, nominally, 0.2 inches. This size shim then will be placed adjacent every tenth ($n^{th}$) anti-vibration bar as seen by the pair of cross-section lines labeled 5—5 in FIG. 4.

Figure 9:
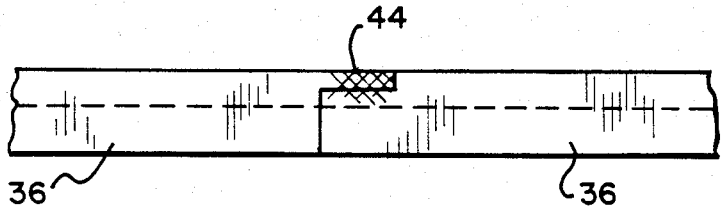
FIG. 9 is a side elevational view of a joint between two shim modules.

In inserting the shims 36, it is important to notice that the shim is modular and made up of longitudinal sections of approximately 12 inches long. As seen in FIG. 9, these modular sections then are provided with lap joints at their ends and are spot welded to attach the sections to each other as seen at 44. The shim 36 is completed when the last module is welded to the top of the anti-vibration bar 28 at its end to secure it in position. As previously stated, after the initial shim is placed, the operation involves continuing adding shims to every tenth anti-vibration bar until the bundle is completed, in the case where n=10. The final step of the method is to weld new wrap-around bars 28 to the anti-vibration bars 34 at their exposed end adjacent the outermost tubes 30 of the bundle 20.

Thus, it will be seen that a method of fixing a nuclear steam generator having anti-vibration bars for limiting the motion of the spaced heat exchanging tubes is provided by locating a shim 36 at intervals n frequent enough to take up the space between the tubes 30 and the anti-vibration bars 34 to eliminate impacting or fretting which may cause breach of the tube and the passage of liquid coolant within the tube to the secondary side of the heat exchanger 10. The improved structure and method are set forth in the claims to follow.

We claim:

1. In a nuclear steam generator having anti-vibration bars for limiting the motion of spaced heat exchanging tubes, the improvement comprising:

a shim located between every $n^{th}$ tube, said shims having a thickness equal to n times the dimensional difference (x−y) of the distance x between a pair of tubes and the width y of an anti-vibration bar between the tubes, where n is greater than one.

2. The improved generator of claim 1 in which the shim engages three sides of an anti-vibration bar.

3. The improved generator of claim 1 in which the shims are channel-shaped in cross-section and the channel is dimensioned to receive an anti-vibration bar.

4. The improved generator of claim 1 in which the shims are made up lengthwise of a plurality of modules.

5. The method of reducing vibration damage to heat exchanging tubes of a tube bundle in nuclear steam generators having anti-vibration bars located between the tubes and attached at their ends to wrap-around bars on the outside of the tube bundle, which method includes the step of:

cutting and removing the wrap-around bars from the outside of the tube bundle;

inserting and expanding a bladder to spread a pair of tubes in the bundle on opposite sides of an anti-vibration bar apart;

moving the anti-vibration bar between the pair of tubes to one side of the opening created by the bladder;

inserting a shim of modular lengths between the anti-vibration bar and one tube of said pair of tubes;

repeating the bladder inserting and expanding, the anti-vibration bar moving and the shim inserting steps at intervals along the bundle; and welding a wrap-around bar to the ends of the anti-vibration bars on the outside of the tube bundle.

* * * * *